US005770013A

United States Patent [19]

Chance et al.

[11] Patent Number: 5,770,013

[45] Date of Patent: Jun. 23, 1998

[54] METHOD FOR MANUFACTURING PAPER AND PAPER FABRICATED FROM THE SAME METHOD

[75] Inventors: Nicholas R. Chance, Lewiston, Id.; Christopher J. Elskamp, Clarkston, Wash.; Timothy H. Switzer, Lewiston, Id.

[73] Assignee: Potlatch Corporation, Cloquet, Minn.

[21] Appl. No.: 668,283

[22] Filed: Jun. 21, 1996

[51] Int. Cl.[6] ..... D21H 23/24

[52] U.S. Cl. ..... 162/127; 162/129; 162/130; 162/135; 162/136; 162/142; 162/147; 162/175; 162/184; 162/206

[58] Field of Search ..... 162/129, 130, 162/127, 125, 142, 147, 175, 184, 135, 136, 206; 427/395

[56] References Cited

U.S. PATENT DOCUMENTS

| | | | |
|---|---|---|---|
| 3,791,917 | 2/1974 | Bolton | 162/130 |
| 4,888,092 | 12/1989 | Prusas et al. | 162/130 |
| 4,964,915 | 10/1990 | Blixt et al. | 162/175 |
| 5,227,024 | 7/1993 | Gomez | 162/142 |
| 5,433,826 | 7/1995 | Glomb et al. | 162/184 |

FOREIGN PATENT DOCUMENTS

| | | | |
|---|---|---|---|
| 961333 | 1/1975 | Canada | 162/175 |
| 1964531 | 7/1971 | Germany | 162/175 |

OTHER PUBLICATIONS

Casey, *Pulp and Paper,* 3rd ed (1981) vol. III, pp. 1486, 1487, 1694, 1695.

*Primary Examiner*—Peter Chin
*Attorney, Agent, or Firm*—Wells, St. John, Roberts, Gregory & Matkin, P.S.

[57] ABSTRACT

A method for manufacturing paper having given physical characteristics is described, and which includes, providing a paper stock slurry of a given composition; removing water from the paper stock slurry to form a continuous sheet of paper; and without the use of a sizing press, providing and applying an aqueous solution of a substantially amylose free starch to the resulting paper in a predetermined amount effective to provide the resulting paper with the given physical characteristics, the paper manufactured at a production rate which is at least 10% faster than the production rate which can be achieved for substantially identical paper having the same given physical characteristics, but which is manufactured using a sizing press.

15 Claims, 4 Drawing Sheets

METHOD FOR MANUFACTURING PAPER AND PAPER FABRICATED FROM THE SAME METHOD

TECHNICAL FIELD

The present invention relates generally to a method for manufacturing paper and paper manufactured by the same method, and more specifically, to a method for manufacturing paper which provides increased manufacturing efficiency and speed when compared with the previous prior art practices.

BACKGROUND OF THE INVENTION

The art of true paper making had its origins in China around 100 A.D. based upon the discovery that a dilute suspension of fiber could be formed into a mat by filtering the suspension through a fine screen. The mat was then suitable for writing and drawing once the mat was subjected to pressing, drying and sizing. Paper continued to be made by hand up until the beginning of the 19th Century. The first paper making machine ever to be built was successfully operated in England in 1803.

Since the earliest days of paper making, paper machine design has undergone continuing development, making it possible to make wider webs of paper, at ever increasing speeds, and to more exacting standards of quality. While the fundamental elements of most paper making machines has remained constant, operators of paper making machinery are constantly on the alert to find new methods of increasing the speeds of operation while simultaneously maintaining the same or similar quality standards.

Shortly after the development of the basic paper machine, a cylinder former was developed for use therewith. A cylinder former facilitated the manufacture of the first paperboards. In this regard, paperboards can be loosely defined as a stiff and thick paper. The line of demarcation between paper and paperboard is somewhat vague, but has been set by ISO at a grammage of approximately 224 grams per meter square. Therefore, material above 224 grams per meter square is termed board while lighter weights fall into the category of paper. While no standard has been set for caliper, the 224 gram per meter square basis weight corresponds roughly to a caliper of about 0.10 inches or "ten points". Paperboard can have a single ply or multi-ply structure; further, it can be manufactured on a single fourdrinier wire or on a series of formers of the same type or combination of types.

Following wet end operations which concludes with pressing, a sheet of paper, in the manufacturing process, is conveyed through a dryer section where residual water is removed by evaporation. On conventional paper machines, the thermal energy employed for evaporating the water out of the paper is made available by means of wrapping the paper around a series of large diameter, rotating, steam filled cylinders. By most estimates, the massive dryer section employed with conventional paper machines is the most expensive part of the paper machine in terms of capital cost. It is also the most costly to operate because of the high energy consumption associated with same. Therefore, efforts to increase the evaporation rate to reduce the number of dryers and conserve energy, thereby reducing steam usage, have heretofore been the focus of some attention by efficiency experts.

In the formation of paperboard such as what is utilized in milk cartons and similar products, the paperboard exiting the dryer section passes through a size press. In this regard, sizing operations are carried out primarily to provide the paperboard with resistance to penetration by aqueous solutions. Sizing operations also provides the paperboard with better surface characteristics, and, further, provides certain physical properties to the paperboard, such as surface strength and internal bond. In particular, surface sizing operations typically utilize starch particles to fill the surface voids in the paperboard thereby reducing pore radius and thus the rate of liquid penetration. Still further, there is another form of sizing, that is, internal sizing which utilizes rosin or other chemicals to reduce the rate of water penetration by effecting the contact angle.

There are many advantages to be achieved by utilizing surface sizing in relation to internal sizing. It will be recognized, however, that surface sizing does not replace wet end chemical addition, it merely provides a means for adding additional materials to the paper which cannot be added by means of wet end chemical processing. One of the major differences between surface and internal sizing is that surface sizing provides more specific action and optimum control. Further surface sizing is less sensitive to changes in wet end operations. Still further, surface sizing appears to result in a substantially 100% retention of additives and reduces wet end deposits on the surface of the resulting paperboard. Moreover, surface sizing increases press cloth life due to lower deposits and additionally appears to improve the overall quality of the resulting paperboard. On the other hand, surface sizing has several disadvantages, chief among them being the additional capital investment required for the installation and maintenance of sizing and associated drying equipment, and the additional operational costs related to the energy consumption required for drying the paperboard due to the subsequent sizing operations. Additionally, the utilization of a size press still provides another potential problem site which can cause a shut down of a paper machine upon malfunction.

Typically, surface sizing operations take place, most commonly, at a station which is located between dryer sections. The most common substance used in a surface sizing solution is starch, either cooked or in a modified form, that is, oxidized or enzyme converted. On occasion, wax emulsions or special resins are added to this solution. Other agents may also be used, as well, to provide specific strength and particular optical characteristics.

Sizing solution is commonly applied to the multi-ply paper as it passes between a two-roll nip; hence the term "size press". Size presses come in various forms, including vertical, horizontal or inclined. In each case, however, the objective is to flood the entering nip with sizing solution. When this occurs, the paper passing through the nips absorb some of the solution and the balance is removed from the nip. The overflow solution is collected below the nip and recirculated back to the nip. The retention time of the multi-ply sheet in the pond and nip of the size press is very brief and consequently, the sizing operation must be carefully controlled to insure that the requisite amount of solids suspended in the sizing solution is absorbed uniformly across the multi-ply sheet. At the same time, the amount of water absorption should be minimized so that the steam requirement for subsequent drying is maintained at the lowest level. The main variables affecting the size press performance relate to the multi-ply sheet or paperboard characteristics; sizing solution composition; and design and operation of the size press. There are two basic mechanisms for incorporating starch solutions into the multi-ply sheet or paperboard at the size press. The first mechanism is the ability of the multi-ply sheet or paperboard to absorb the sizing solution; the second is the amount of sizing solution film passing through the nip, and the manner in which the paperboard and roll surfaces separate. Still further, other factors such as sheet moisture has a significant effect on the rate of sizing solution absorption.

As will be appreciated from the discussion above, the size press, and limitations associated therewith, provides serious impediments to increasing the rate of operation of a paper machine in view of the adjustments which must be made to provide optimum sizing of multi-ply paper and paperboard being manufactured therewith.

Attempts made in the art, to eliminate the size press from paperboard manufacturing have been largely unsuccessful. In most instances, an attempt to remove the size press has often resulted in a subsequent paper machine malfunction and paper quality degradation, and/or, lower line speeds, thereby decreasing the profitability of same. In particular, these attempts to remove the size press have been largely unsuccessful because to facilitate the resulting paper to pick-up or absorb the same amount of starch, manufacturers are forced to provide a starch solution having a higher solids content. As will be discussed in further detail below, as the solids content of the prior art starch solutions increase, retrogradation occurs. This retrogradation, in turn, causes the paper machine to produce a paper which does not meet most manufacturers' standards.

As was discussed above, adverse chemical reactions (retrogradation) has been associated in whole or in part, to the inability to recover the quality characteristics of the paperboard as provided by a manufacturing process which employs a size press. In this regard, it should be understood that the most commonly used starch variety used in the paper industry is derived from so called "pearl corn", "dent corn" or "maize". The "pearl starch" used heretofore contains two structurally different polysaccharides, that is, amylose, which is a substantially linear polymer; and amylopectin, which is a branched polymer. Pearl starch is composed of approximately 27% amylose, and 73% amylopectin. Amylopectin has a molecular weight which is in excess of 100 million, and amylose has a molecular weight of about 130,000. In addition to the wide variation in molecular weights, the two molecules, amylose and amylopectin, contribute in different ways to starch cooking stability. In this regard, the primary factor that determines starch cooking stability is the amylose content of the starch. In particular, starch cooking instability is the result of the association of amylose molecules, which displaces water and which makes the associated amylose molecules insoluble. This association of molecules forms crystals. At high solids concentration (about 20% at the wet calender end) a gel forms. Further, these same crystals precipitate out of solution. This has been termed, as noted above, "retrogradation." The precipitated amylose crystals are what size press "sludge" is composed of. While such sludge is normally removed by filtration, this same sludge can, as earlier discussed, cause subsequent paper quality degradation or other paper machine malfunctions. Amylopectin, on the other hand, does not readily retrograde in solution, as the branched molecules makes it difficult for a tightly packed crystalline structure to form.

Therefore, it has long been known that it would be advantageous to provide a paper making process which could be utilized for paper and paperboard products and which would substantially eliminate the need for utilizing a size press, while achieving the same or similar quality of paper as provided by the size press operation, and which further could be implemented in a manner which would increase the profitability of the paper making process as compared to the prior art manufacturing methods utilized heretofore.

SUMMARY OF THE INVENTION

Therefore, one aspect of the present invention is to provide an improved method for manufacturing paper.

Another aspect of the present invention relates to a method for manufacturing paper wherein, without the use of a sizing press, an aqueous solution of a substantially amylose free starch is applied to a resulting paper in a given amount effective to provide the resulting paper with predetermined physical characteristics.

Another aspect of the present invention is to provide a method for manufacturing paper on a paper machine wherein, without the use of a sizing press, paper is manufactured at a rate which is at least 10% faster than the manufacturing rate which can be achieved for substantially identical paper, having substantially the same given physics characteristics on the same paper machine, using a sizing press.

Another aspect of the present invention is to provide a method for manufacturing paper having given physical characteristics, and wherein a three-ply paper is provided, and which includes a pair of outer plies, and an inner ply sandwiched between the outer plies, and wherein the pair of outer plies comprise short wood fibers in an amount of about 10% to about 30% by weight, of the outer plies.

Another aspect of the present invention is to provide a method for manufacturing paper wherein, an aqueous solution of a substantially amylose free starch is applied to a resulting paper at a solids concentration of about 8% to about 15%.

Another aspect of the present invention is to provide a method for manufacturing paper wherein, the resulting paper is multi-ply, and wherein the multi-ply paper includes a pair of outer plies, and an inner ply sandwiched between the outer plies, and wherein the resulting multi-ply paper has about 30 to about 40 pounds, per ton, of a substantially amylose free starch incorporated therein, the substantially amylose free starch made integral with the resulting multi-ply paper by a manufacturing method which does not employ a sizing press.

Still further, another aspect of the present invention relates to a method for manufacturing paper having given physical characteristics, and wherein the paper machine which fabricates the multi-ply paper has a plurality of dryer sections, and wherein the substantially amylose free starch is made integral with the multi-ply paper prior to the resulting multi-ply paper passing through the last dryer section.

Yet still another aspect of the present invention is to provide a method for manufacturing paper which is operable to obtain the individual benefits to be derived from related prior art devices and practices, while avoiding the detriments individually associated therewith.

Further aspects and advantages of the present invention are to provide improved elements and arrangements thereof in a method for manufacturing paper for the purposes intended, and which is dependable, economical, and fully effective in accomplishing these intended purposes.

These and other objects and advantages are achieved in a method for manufacturing paper having given physical characteristics by a paper machine comprising:

providing a paper stock slurry of a given composition to the paper machine;

removing water from the paper stock slurry to form a resulting substantially continuous sheet of paper; and without the use of a sizing press, providing and applying an aqueous solution of a substantially amylose free starch to the resulting paper in a predetermined amount effective to provide the resulting paper with the given physical characteristics, the resulting, paper manufactured at a production rate which is at least 10% faster than the production rate which can be achieved for substantially identical paper having the same given physical characteristics, but which is manufactured using a sizing press on the same paper machine.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
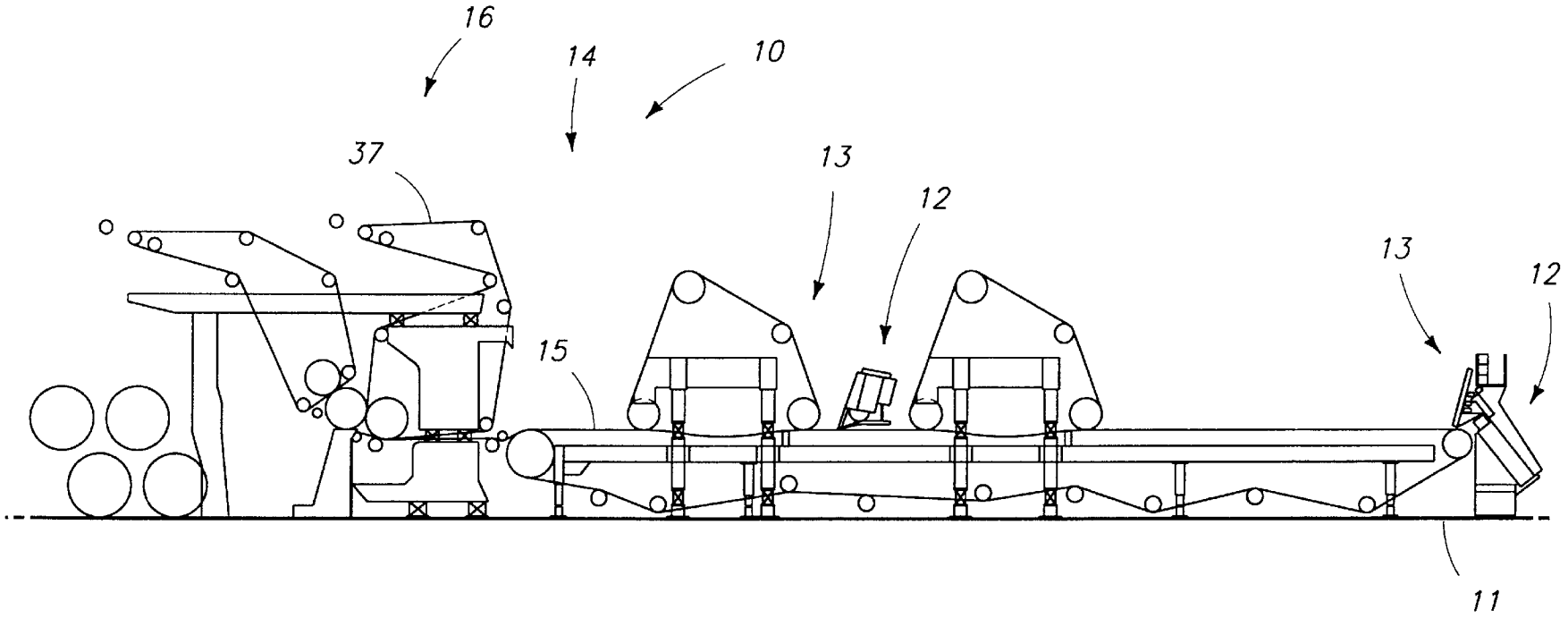
FIG. 1 is a simplified, greatly reduced, fragmentary, side elevation view of a paper making machine which utilizes the method of the present invention.
Figure 2:
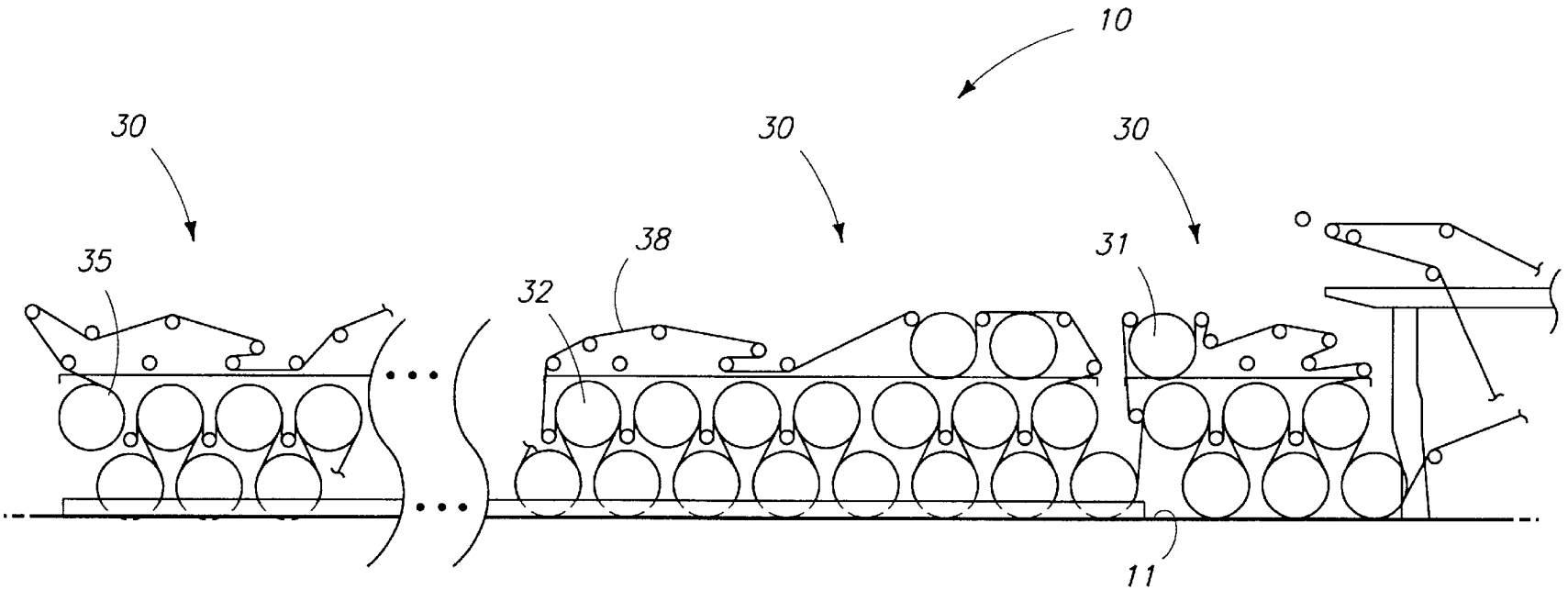
FIG. 2 is a simplified, greatly reduced, fragmentary, side elevation view of a second portion of a paper making machine which incorporates the method of the present invention.
Figure 3:
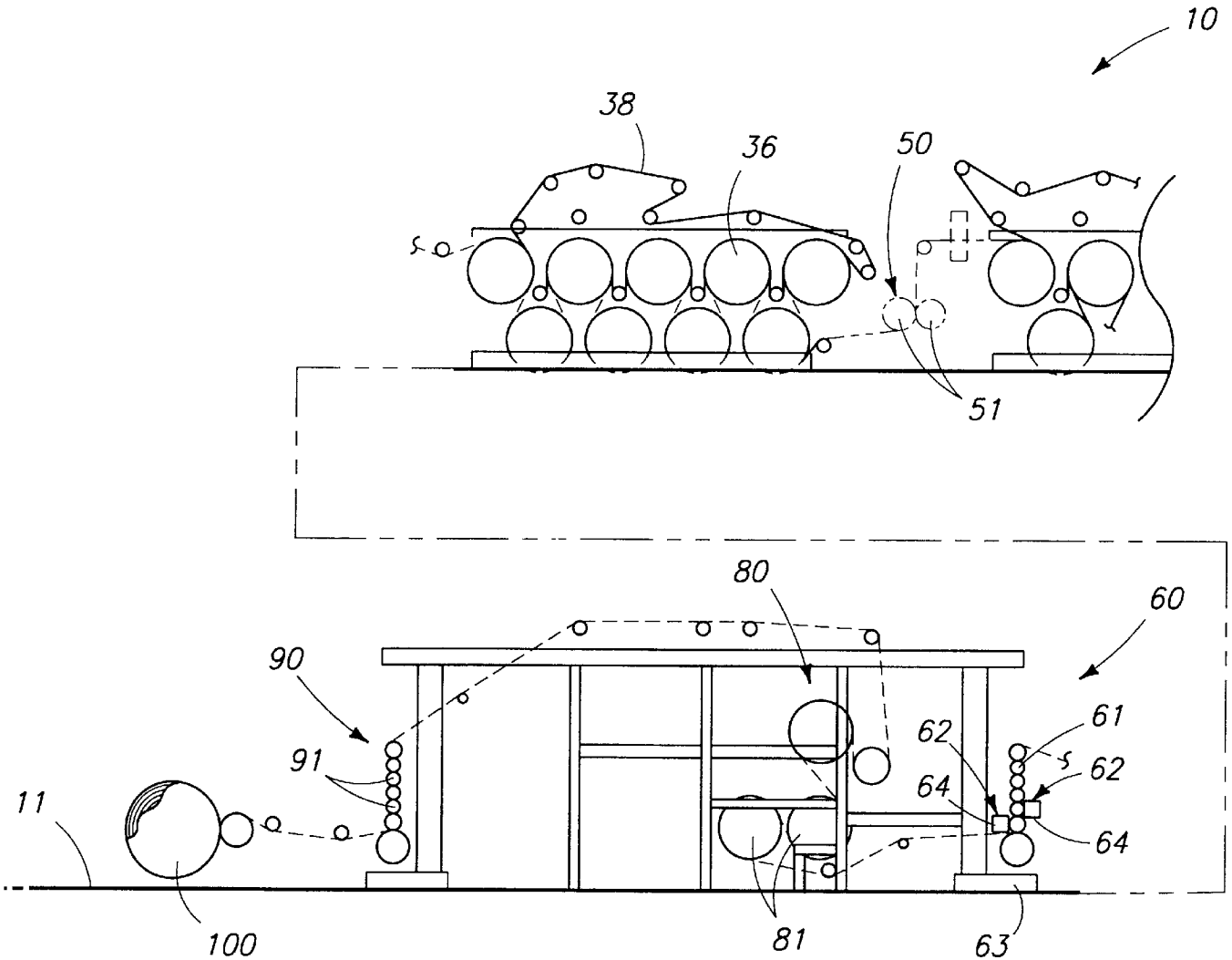
FIG. 3 is a simplified, greatly reduced, fragmentary, side elevation view of a third portion of a paper making machine which incorporates the method of the present invention.

The method for manufacturing paper of the present invention is best understood by a study of FIGS. 1, 2, and 3, respectively. FIGS. 1, 2 and 3 are illustrated sequentially, and provide a greatly reduced, fragmentary, side elevation view of a paper making machine which can be utilized to fabricate paper or paperboard in accordance with the teachings of the present method. The paper making machine is generally indicated by reference to the numeral 10.

Referring now to FIG. 1, the paper making machine 10 is mounted on the surface of the earth 11. As should be understood a paper stock slurry 12 is provided to the head box, which is generally indicated by the numeral 13. The head box is of conventional design and therefore for purposes of brevity, is not discussed in further detail herein. The slurry may further include a plurality of individual slurries of different pulp compositions. The various paper stock slurries 12 will be discussed in further detail, hereinafter. The individual paper stock slurries are brought together after passing through the head box 13, in an initial water removal or sheet forming area which is generally designated by the numeral 14. Those skilled in the art will recognize that water is rapidly removed in this area. This process results in a sheet of multi-ply paper 15 being formed and which has given characteristics.

After passing through the initial water removal or sheet forming area 14, the resulting multi-ply paper 15 now proceeds through a press section 16, and then on to plurality of dryer sections which are generally designated by the numeral 30. The individual dryer sections are designated by the numerals 31, 32, 35 and 36 respectively. Still further, an after-calender dryer 80 is also provided. The individual dryer sections are of conventional design having a plurality of rotatable dryer rolls which are provided with steam heat from an exterior location (not shown). The rotatable dryer rolls provide a means for driving off or evaporating moisture from the resulting multi-ply paper 15. Also, as seen in FIGS. 1 and 2, a continuous fabric or press felt 37, is provided and which further facilitates the removal of water from the resulting multi-ply paper 15. A somewhat similar dryer felt 38 is provided for each dryer section.

Referring now to FIG. 3, a conventional size press 50 is shown, in phantom lines. The illustration of the sizing press 50, shows the normal location of the sizing press during conventional manufacturing. The sizing press 50 is not employed in the present method. As earlier discussed, in conventional paper, or paperboard fabrication, a sizing press 50 would normally be employed, at this location, to introduce an aqueous solution of starch to the paper or paperboard passing therethrough. The sizing press 50 comprises a pair of nip rolls 51 which counter-rotate, one relative to the other, the resulting multi-ply paper 15 passing between the pair of nip rolls 51. The aqueous solution of starch is introduced into the nip to form a pond, not shown, and any excess solution is collected and recirculated back to the nip.

When employing the prior art process, on a paper machine having an approximate width of 200 inches, and which includes a size press 50, a gross production rate in the range of approximately 26 to about 30 tons per hour of paper 15 can normally be achieved. As should be understood, production rates in excess of this amount have not been achievable on a paper machine of this same type and with similar drying capacities, in view of the several limitations the size press 50 presents to the prior art manufacturing methods. For example, those skilled in the art will recognize that the size press 50 impedes increased production rates because it rewets the paper thereby requiring the paper 15 to be dried again with the attendant costs associated therewith, and further in view of the adverse chemical reactions which can occur at high solids concentrations in the prior art starch solution. As earlier discussed, precipitates from the sizing solution can become deposited on the resulting paper 15. In particular, the starch employed, heretofore, as earlier discussed, has included a starch having a substantial portion of which comprises amylose. Such starch has been commercially available from manufacturers such as Minnesota Corn Processors under the trade designation Starch Corn CS. As should be understood, the amylose, in the presence of heat, and pressure, can degrade to form various undesirable compositions which can, under certain environmental circumstances, degrade the quality of the resulting paper 15, and further hamper production rates. In particular, the commercially available starch employed heretofore, so-called "pearl starch" has about 27% amylose and about 73% amylopectin. These constituent elements, under particular environmental circumstances, degrade the production rate performance of the paper making machine 10 by self associating to form crystals.

In view of the perceived limitations provided by the sizing press 50, attempts have been made in the prior art practices to remove this same subassembly from the paper making machine 10. These attempts have been largely unsuccessful in view of the limitations provided by the prior art sizing solution which has been employed heretofore. In particular, and as noted above, removal of the sizing press has resulted in quality control problems for the resulting multi-ply paper 15 and further, degraded production rates for the resulting paper making machine 10.

The present method which is employed to manufacture a paper having given physical characteristics comprises, providing a paper stock slurry 12 of a given composition, the paper stock slurry provided at the initial sheet forming area 14; removing water from the paper stock slurry 12 at the sheet forming area 14 to form a continuous sheet of paper 15; and without the use of a sizing press 50, providing and applying an aqueous solution of a substantially amylose free starch to the resulting paper 15 in a predetermined amount to provide the resulting paper with the given physical characteristics. Surprisingly, the inventors have discovered that paper or paperboard 15 manufactured without the use of a sizing press 50, and employing the substantially amylose free starch, in an aqueous solution, has resulted in production rate increases which are at least 10% faster than the productions rates which can be achieved for substantially identical paperboard 15 having the same given physical and quality control characteristics but which is manufactured using a sizing press 50. As should be understood, the aqueous solution of substantially amylose free starch includes a stabilizing, non-ionic acetyl group. The substantially amylose free starch will be discussed in the paragraphs which follow.

As earlier discussed, the paper making machine 10 has been modified to remove the sizing press 50, it being shown in phantom lines in FIG. 3. The paper 15 or paperboard then proceeds through a first calender section or wet calender stack which is generally indicated by the numeral 60. The first calender section or wet stack comprises a plurality of rolls which are generally indicated by the numeral 61; and a pair of water boxes 64. The aqueous solution of substantially amylose free starch is introduced at the first calender section by means of the water boxes 64. The source of substantially amylose free starch 62 is provided to the plurality of rolls 61 and water boxes 64 and is incorporated in the paper 15 passing therethrough. A catch basin 63 is provided to collect any non-incorporated amylose free starch solution. A commercially, suitable substantially amylose free starch may be secured from the National Starch and Chemical Company under the trade designation "Kofilm". Prior to the introduction of the aqueous solution of the substantially amylose free starch at the first calender section 60, the aqueous solution of substantially amylose free starch 62 is prepared. In this regard, a source of substantially amylose free starch is provided in a non-aqueous form. The non-aqueous form of substantially amylose free starch is then diluted with water to achieve a first given concentration. Upon achieving this first given concentration, the resulting solution is heated, in the absence of enzymes, to a temperature of about 190 degrees F. for a period of time of at least about 20 minutes. Following the heating of the resulting solution of substantially amylose free starch, it is again diluted, in an amount to provide a second given concentration. As provided at the first calender section 60, the aqueous solution of substantially amylose free starch 62 has a solids concentration of at least about 8% to about 15%. Still further, the substantially amylose free starch comprises about 1.5% to about 2.0%, by weight, of the resulting multi-ply paper 15. This is equivalent to about 30 lbs, to about 40 lbs per ton.

After passing through the first calender section or wet stack 60, the multi-ply paper 15 moves through a last dryer or after-calender section which is generally indicated by the numeral 80. This after-calender dryer includes a plurality of dryer rolls 81, which are of similar design to that earlier disclosed. After passing through the after-calender dryer 80, where the paper is dried, again, to a given amount, the resulting paper 15 passes through a second calender section 90 which includes a plurality of calender rolls 91. This is commonly referred to as the dry stack. The resulting paper 15 is thereafter collected on a product roll 100, in a conventional fashion, for subsequent handling and shipping.

As noted earlier, the method of the present invention includes the use of a substantially amylose free starch solution which is incorporated into a paper 15 without the use of a sizing press 50 and by means of a pair of water boxes 64. Further, the paper machine 10 which produces the paper 15 has a plurality of dryer sections 30, and wherein the substantially amylose free starch 62 is incorporated into the resulting paper 15 prior to the resulting paper 15 passing through the last dryer section 80. The method of the present invention causes the resulting paper 15 to have about 30 lbs to about 40 lbs per ton of substantially amylose free starch incorporated therein. Further, the production rates experienced by employing the present method are at least 10% faster, while simultaneously producing a paper having substantially the same physical characteristics as the paper produced by the manufacturing process which employs the sizing press while utilizing the same paper machine.

Figure 4:
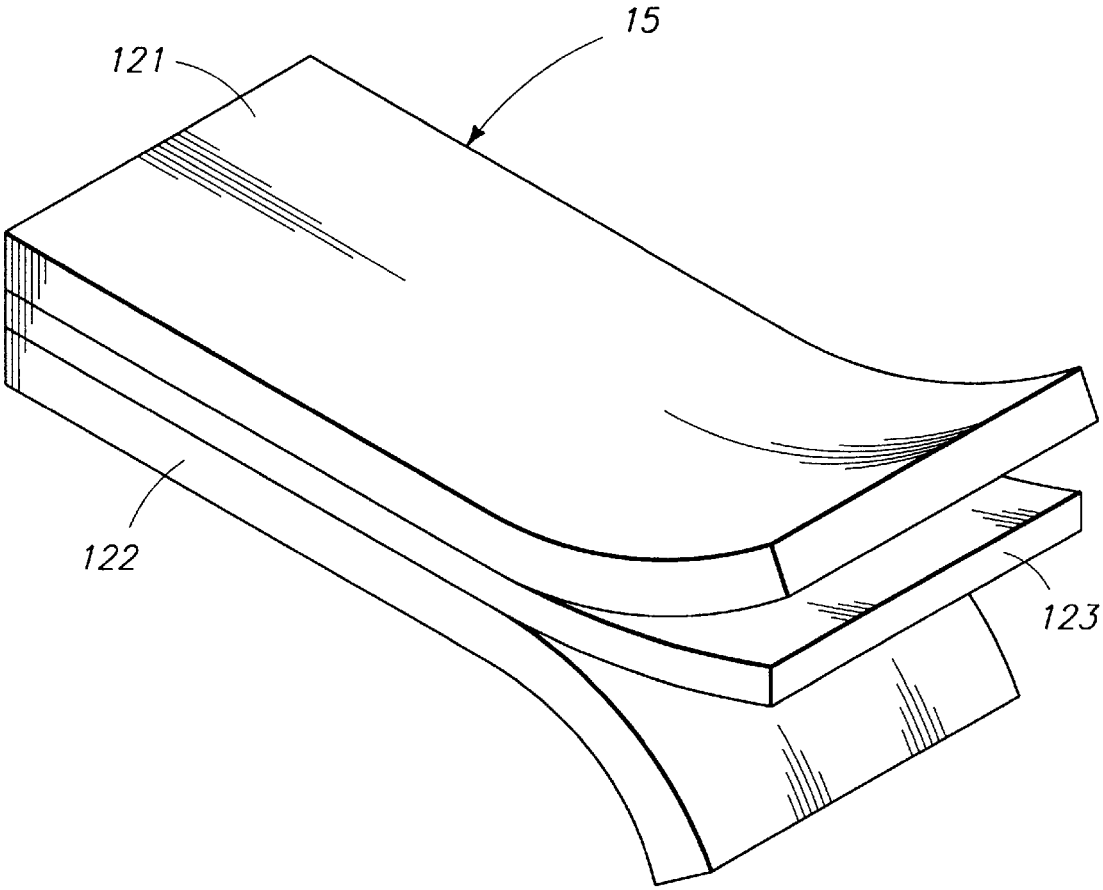
FIG. 4 is a greatly enlarged, exploded, perspective view of a resulting multi-ply paper fabricated in accordance with the method of the present invention.

Referring now to FIG. 4, a greatly enlarged, perspective, exploded view of a multi-ply paper 15 which is fabricated in accordance with the method of the present invention is shown. As illustrated therein, the resulting multi-ply paper 15 includes a pair of outer plies 121 and 122 respectively, and an inner ply 123 sandwiched between the outer plies 121 and 122. The multi-ply paper 15 comprises short wood fibers in an amount of about 20% to about 25%, by weight, of the resulting multi-ply paper 15. In particular, the short wood fibers comprise about 5% to about 70% sawdust, and the inner ply has at least about 1% sawdust. Further, the resulting multi-ply paper 15 fabricated in accordance with the method of the present invention comprises paperboard having a caliper of approximately 10 points.

It will be recognized, therefore, that the method of the present invention can be utilized successfully in the fabrication of a multi-ply paper 15 comprising, a pair of outer plies 121, and 122; and an inner ply 123 sandwiched between the outer plies, and wherein the resulting multi-ply paper 15 has about 30 lbs to about 40 lbs per ton of a substantially amylose free starch 62 incorporated therein. The substantially amylose free starch 62 is made integral with the resulting multi-ply paper by a manufacturing method which does not employ a sizing press 50. As discussed, above, the inner and outer plies comprise short wood fibers in an amount of about 20% to about 25% by weight of the resulting multi-ply paper 15.

OPERATION

The operation of the preferred form of the present method is believed to be readily apparent and is briefly summarized at this point. As will be recognized from a study of FIGS. 1 through 4, the method for manufacturing paper having given physical characteristics comprises, as a first step, providing a plurality of paper stock slurries 12 of a given composition. Thereafter, the method further includes multi-ply forming the plurality of paper stock slurries 12 effective to provide a resulting multi-ply paper 15 having at least three plies, 121, 122, and 123, respectively. The resulting three-ply paper has a pair of outer plies 121 and 122, and an inner ply 123 sandwiched between the inner and outer plies. The inner and outer plies comprise short wood fibers in an amount of about 20% to about 25%, by weight, of the resulting three-ply paper 15. The method further includes removing water from the plurality of paper stock slurries 12 to form a continuous sheet of multi-ply paper 15 having at least three plies; and without the use of a sizing press 50, providing and applying an aqueous solution of substantially amylose free starch 62, by means of water boxes 64, having a solids concentration of about 8% to about 15%, by weight, to the multi-ply paper 15. The resulting multi-ply paper 15 has about 30 lbs to about 40 lbs per ton of the substantially amylose free starch made integral therewith to provide the resulting multi-ply paper with the given physical characteristics. The resulting multi-ply paper is manufactured at a production rate which is at least 10% faster than the production rate which can be achieved for substantially identical multi-ply papers having the same given physical characteristics, but which is manufactured using a sizing press 50. The paper machine 10 which produces the multi-ply paper has a plurality of dryer sections 30, and wherein the substantially amylose free starch is incorporated in the resulting multi-ply paper 15 prior to the resulting multi-ply paper 15 passing through the last dryer section 80.

The method of the present invention is further demonstrated by the examples provided below.

EXAMPLE 1

A "no-size" press trial was conducted on a paper machine substantially identical to that shown in FIGS. 1, 2 and 3, respectively. The objective of the test was to produce a paperboard sheet 15 that met quality control specifications, without the use of the size press. Further, the trial data would be used to evaluate drying, and the extent of any production rate increases. The trial plan is set forth below.

Following the purging of a pearl starch silo connected in supplying relation relative to the paper machine 10, the silo was recharged with substantially amylose free starch which was purchased from National Starch Manufacturing Company under the trade designation Kofilm 280. Prior to the trial, the Kofilm 280 was provided to the sizing press at normal solids concentration. This insured a complete flush of the slurry lines provided to the sizing press 50. This was done to inhibit residual pearl starch buildup. In preparing the substantially amylose free starch solution, the starch was prepared as outlined above, in the absence of enzymes. The aqueous solution of Kofilm 280 was prepared and supplied to the water boxes 64 of the paper machine 10 at a solids concentration of approximately 10%. Upon achieving this concentration, the sizing press operation was discontinued by stopping the flow of sizing solution, and opening the nip. Thereafter, operating personnel adjusted the steam and speed of operation of the dryers 30, as needed, to accommodate the lengthened main dryer section, that is, they maximized steam in the last of the dryer sections. Thereafter, paper 15 was collected, at predetermined intervals, to determine whether the production method achieved the given quality control standards. Trial rolls were further collected for use during in-plant, durability evaluations. The paper machine 10 was allowed to stabilize, and the speeds were increased until a production rate of nearly 34 tons per hour was achieved. This represented an increased production rate of greater than about 10 percent over the prior art method which included the use of a sizing press. The paper rolls that were collected were further tested with respect to Sheffield smoothness, moisture variation, basis weight caliper, and other physical test parameters. The test rolls examined met or exceeded all quality control parameters.

EXAMPLE 2

In a second trial conducted on the same paper machine 10 noted above, paperboard 15 was manufactured for use in milk carton production without the use of a sizing press 50. During regular production, and following the same method as noted above relative to the introduction of the substantially amylose free starch, (Kofilm 280), the starch solution was added to the water boxes, and the sizing press 50 was turned off. Twenty-Seven minutes later, the paper machine 10 was essentially on-grade for the paperboard employed with the milk carton. Wet end chemical addition was unchanged, and the most significant wet end change was a drop of sawdust used in the outer plies (from 55% to 35%) due to low sawdust pulp inventory. Further, pre-dryer steam was lowered. As the trial proceeded, line speed was gradually increased until it reached 970 feet per minute. Calender use tank inventory measurements demonstrated that the paperboard had absorbed a total of approximately 37 lbs per ton, or about 4 lbs per ream, (3,000 square feet) of the substantially amylose free starch. Still further, the analysis of the paperboard indicated that at the speed of 970 feet per minute, moisture content of the paper was at acceptable levels. Further, Sheffield smoothness improved, and target stiffness was maintained. Moreover, the moisture profile appeared normal. The gross production increase on this second trial was about 6 tons per hour or approximately 144 tons per day. This represented a production rate increase of greater than about 10%.

It will be seen, therefore, that the method of the present invention provides highly desirable economic benefits. In particular, the method of the present invention provides increased production rates not possible heretofore while simultaneously producing paper having substantially identical quality characteristics. Still further, the costs attendant to utilizing a sizing press are substantially eliminated. Moreover, the method of the present invention addresses a long felt need to eliminate the sizing press, while maintaining quality, and increasing profit margins. In addition to the foregoing, the failure of others in the art to eliminate the sizing press, and further, the recognition by those skilled in the art that the sizing press presented a severe impediment to increasing production rates teaches away from the present method. Finally, the present method has unexpected, and surprising results in view of materials employed.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. A method for manufacturing a multi-ply paperboard by using a paper machine which has a sizing press and a wet calendar stack, comprising:

rendering the sizing press inoperable;

providing a plurality of paper stock slurries to the paper machine to form a substantially continuous multi-ply sheet of paperboard, and wherein the substantially continuous multi-ply sheet of paperboard includes a pair of outer plies, and an inner ply sandwiched between the outer plies, and wherein the outer plies each have about 5% to about 70% pulp from sawdust, and the inner ply has at least 1% pulp from sawdust;

removing water from the paper stock slurries to form the resulting, substantially continuous multi-ply sheet of paperboard; and providing and applying an aqueous solution of a substantially amylose free starch to the multi-ply paperboard at the wet calendar stack to provide the resulting multi-ply paperboard with about 30 pounds to about 40 pounds per ton of the substantially amylose free starch, the resulting multi-ply paperboard being manufactured at a production rate which is at least 10% faster than the production rate which can be achieved for substantially identical paperboard having the same physical characteristics but which is manufactured using the sizing press on the same paper machine.

2. A method as claimed in claim 1, wherein the outer and inner plies comprise short wood fibers in an amount of about 20% to about 25% by weight, of the resulting multi-ply paperboard.

3. A method as claimed in claim 1, wherein the aqueous solution of substantially amylose free starch has a solids concentration of at least about 8% to about 15%.

4. A method as claimed in claim 1, wherein the substantially amylose free starch comprises about 1.5% to about 2.0%, by weight, of the multi-ply paperboard.

5. A method as claimed in claim 1, wherein the aqueous solution of substantially amylose free starch includes a stabilizing non-ionic acetyl group.

6. A method as claimed in claim 1, wherein providing the aqueous solution of the substantially amylose free starch further comprises:

providing the substantially amylose free starch in a non-aqueous form;

diluting the non-aqueous form of the substantially amylose free starch with water to achieve a first given concentration;

heating the aqueous solution of the substantially amylose free starch, in the absence of enzymes, to a temperature of about 190 degrees F. for a time period of at least about 20 minutes; and diluting the heated aqueous solution of the substantially amylose free starch in an amount to provide a second given concentration.

7. A method as claimed in claim 1, wherein the multi-ply paperboard has a caliper of at least about 10 points.

8. A method as claimed in claim 1, wherein the wet calendar stack has a pair of water boxes, and wherein the aqueous solution of substantially amylose free starch is supplied to the water boxes.

9. A method for manufacturing paperboard by using a paper machine which has a sizing press, wet calendar stack and a plurality of dryer sections, the method comprising:

rendering the sizing press inoperable;

providing a plurality of paper stock slurries to the paper machine to form a multi-ply paperboard having at least three plies, and wherein the multi-ply paperboard has a pair or outer plies, and an inner ply, and wherein the outer plies have about 5% to about 70% pulp from sawdust, and the inner ply has at least 1% pulp from sawdust;

removing water from the plurality of paper stock slurries effective to form the continuous sheet of paperboard having the at least three plies;

delivering an aqueous solution of a substantially amylose free starch to the wet calendar stack, the wet calendar stack having a pair of water boxes, and wherein the aqueous solution of substantially amylose free starch is supplied to the pair of water boxes at a solids concentration of about 8% to about 15%;

providing and applying the aqueous solution of the substantially amylose free starch to the resulting multi-ply paperboard as it passes through the wet calendar stack, the resulting multi-ply paperboard having about 1.5% to 2.0%, by weight of the amylose free starch incorporated therein, the resulting multi-ply paperboard being manufactured at a production rate which is at least 10% faster than the production rate which can be achieved for substantially identical paperboard having the same physical characteristics on the same paper machine, but which is manufactured using a sizing press, and wherein the substantially amylose free starch is made integral with the resulting multi-ply paperboard by the action of wet calendar stack prior to the resulting multi-ply paperboard passing through the last dryer section.

10. A method as claimed in claim 9, wherein the aqueous solution of the substantially amylose free starch includes a stabilizing non-ionic acetyl group.

11. A method as claimed in claim 9, wherein the multi-ply paperboard has about 30 lbs. to about 40 lbs., per ton, of the substantially amylose free starch incorporated therein.

12. A method as claimed in claim 9, wherein providing the aqueous solution of the substantially amylose free starch further comprises:

providing the substantially amylose free starch in a non-aqueous form;

diluting the non-aqueous form of the substantially amylose free starch with water to achieve a first given solids concentration;

heating the aqueous solution of the substantially amylose free starch in the absence of enzymes, to a temperature of about 190 degrees F. for a time period of at least about 20 minutes; and diluting the heated aqueous solution of the substantially amylose free starch in an amount to provide a second solids concentration of about 18%, to about 25%, by weight.

13. A method of manufacturing paperboard by a paper machine which has a sizing press, wet calendar stack, and a plurality of drying sections, comprising:

rendering the sizing press inoperable;

providing a plurality of paper stack slurries;

multi-ply forming the plurality of paper stock slurries to provide a multi-ply paperboard having at least three plies, and wherein the resulting three-ply paperboard has a pair of outer plies and an inner ply sandwiched between the outer plies, and wherein the inner and outer plies comprise short wood fibers in an amount of about 20% to about 25% by weight of the resulting three-ply paperboard, and wherein the outer plies have pulp from sawdust in an amount of about 5% to about 70%, and the inner ply has at least 1% pulp from sawdust;

removing water from the plurality of paper stock slurries to form a continuous sheet of multi-ply paperboard having the at least three plies;

providing a substantially amylose free starch in a non-aqueous form;

diluting the non-aqueous form of the substantially amylose free starch with water to form an aqueous solution and achieve a first solids concentration;

heating the aqueous solution of the substantially amylose free starch in the absence of enzymes to a temperature of about 190 degrees F. for a time period of at least about 20 minutes;

diluting the heated aqueous solution of the substantially amylose free starch in an amount to provide a second solids concentration, the second solids concentration being about 8% to about 15%, by weight;

delivering the aqueous solution of the substantially amylose free starch having the second solids concentration to the wet calendar stack, and wherein the wet calendar stack has a pair of water boxes, and wherein the aqueous solution of the substantially amylose free starch is supplied to the pair of water boxes;

providing and applying the aqueous solution of the substantially amylose free starch having the second solids concentration of about 8% to about 15%, by weight, to the three-ply paperboard by utilizing the wet calendar stack, and wherein the resulting three-ply paperboard has about 30 lbs. to about 40 lbs. per ton of the substantially amylose free starch made integral therewith, the multi-ply paperboard manufactured at a production rate which is at least 10% faster than the production rate which can be achieved for substantially identical multi-ply paperboard having the same physical characteristics, by the same paper machine which is using a sizing press, and wherein a paper machine which produces the multi-ply paperboard has a plurality of dryer sections, and wherein the aqueous solution of the substantially amylose free starch is made integral with the resulting multi-ply paperboard by the action of wet calendar stack prior to the multi-ply paperboard passing through the last dryer section.

14. A method as claimed in claim 13, wherein the resulting multi-paper comprises paperboard having a caliper of at least 10 points.

15. A multi-ply paper as claimed in claim 13, wherein the substantially amylose free starch includes a stabilizing, non-ionic acetyl group.

* * * * *

UNITED STATES PATENT AND TRADEMARK OFFICE

CERTIFICATE OF CORRECTION

PATENT NO. : 5,770,013
DATED : June 23, 1998
INVENTOR(S) : Nicholas R. Chance, et al.

It is certified that error appears in the above-identified patent and that said Letters Patent is hereby corrected as shown below:

Column 1, line 44, delete "0.10"and insert --.10--

Column 4, line 19, delete the word "physics"and insert the word --physical--.

Signed and Sealed this

Sixth Day of October, 1998

*Attest:*

*Attesting Officer*

Bruce Lehman

BRUCE LEHMAN

*Commissioner of Patents and Trademarks*